United States Patent [19]

Komuro et al.

[11] 4,383,970

[45] May 17, 1983

[54] PROCESS FOR PREPARATION OF GRAPHITE-CONTAINING ALUMINUM ALLOYS

[75] Inventors: Katsuhiro Komuro, Hitachi; Masateru Suwa, Tokai; Koh Soeno; Masato Ohsawa, both of Hitachi, all of Japan

[73] Assignees: Hitachi, Ltd.; Hitachi Chemical Company, Ltd., both of Tokyo, Japan

[21] Appl. No.: 196,044

[22] PCT Filed: Aug. 9, 1979

[86] PCT No.: PCT/JP79/00211

§ 371 Date: Apr. 11, 1980

§ 102(e) Date: Apr. 11, 1980

[87] PCT Pub. No.: WO80/00352

PCT Pub. Date: Mar. 6, 1980

[30] Foreign Application Priority Data

Aug. 11, 1978 [JP] Japan ..... 53-97227

[51] Int. Cl.[3] ..... C22C 1/02

[52] U.S. Cl. ..... 420/528; 420/529; 420/538; 420/548; 420/550; 420/551; 420/552; 420/553; 420/554

[58] Field of Search ..... 75/138, 139, 140, 143, 75/144, 148

[56] References Cited

U.S. PATENT DOCUMENTS 3,600,163 8/1971 Badia et al. ..... 75/138

*Primary Examiner*—R. Dean

*Attorney, Agent, or Firm*—Antonelli, Terry & Wands

[57] ABSTRACT

A process for preparation of graphite-containing aluminum alloys includes incorporating graphite particles into an aluminum containing melt. When the graphite particles are incorporated, floating of the graphite particles to the surface of the melt is prevented by the use of certain additive metals. Before the graphite particles are incorporated into the melt, titanium, chromium, zirconium, nickel, vanadium, cobalt, manganese, niobium or phosphorus is incorporated and dispersed into the melt. The produced aluminum alloys are suitable to use as dry frictional contacts such as bearings.

22 Claims, 1 Drawing Figure

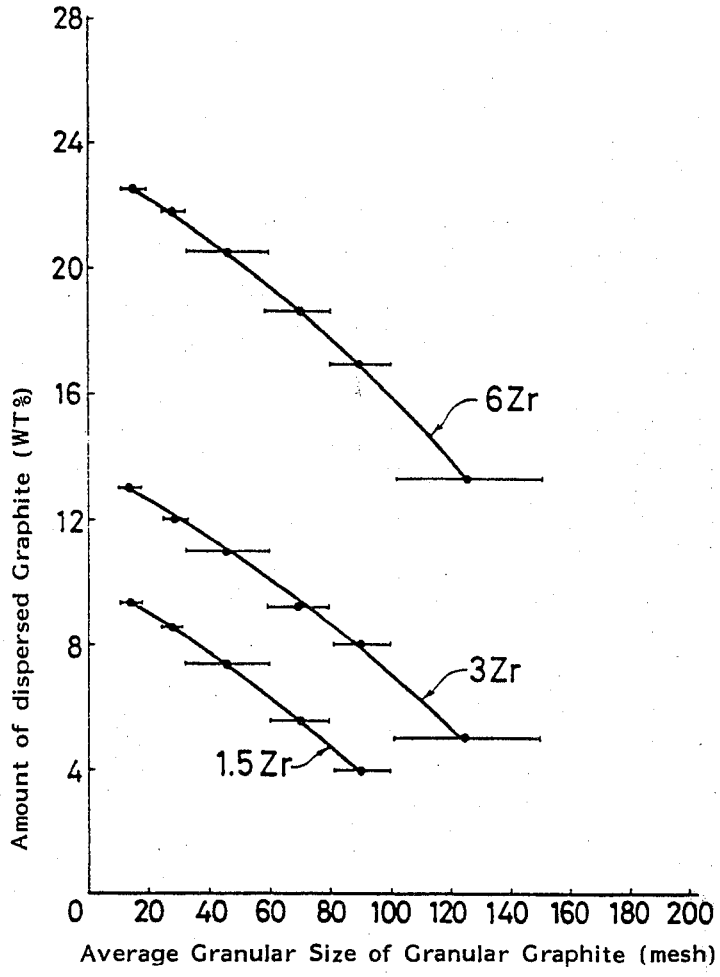
28
24
20
16
12
8
4
0
Amount of dispersed Graphite (WT%)
6Zr
3Zr
1.5Zr
20 40 60 80 100 120 140 160 180 200
Average Granular Size of Granular Graphite (mesh)

PROCESS FOR PREPARATION OF GRAPHITE-CONTAINING ALUMINUM ALLOYS

This invention relates to a process for preparation of graphite-containing aluminum alloys which comprises throwing and dispersing graphite particles, especially graphite particles not coated with a metal, into a melt of aluminum or an aluminum alloy.

For many slip-contact structural elements in internal combustion engines, such as bearings, gears, pistons, cylinders, sliders and the like, metallic alloys containing a solid lubricant are ordinarily used. This method is employed to compensate for a lost in lubrication by providing a self-lubricating action of the solid lubricant when a film of a lubricating oil film is destroyed. It is known that graphite is very suitable as such a solid lubricant. Therefore, various alloys containing graphite particles have heretofore been proposed and manufactured. However, most of metallic alloys containing graphite particles are prepared according to powder metallurgy, so that resulting sintering products do not have sufficient mechanical properties.

In a case of large-size products, the manufacturing cost becomes much higher than in case of cast or forged products. Thus, there has been an earnest effort in the art to develop a casting technique capable of dispersing graphite particles uniformly into metallic alloys without using or floating graphite particles.

More specifically, the following methods have been recently proposed as the technique of dispersing the graphite particles into aluminum (Al) alloy melt (having a graphite solubility lower than 0.01% by weight) with which graphite is metallurgically incompatible, without the floating of graphite particles.

There have been proposed a method in which a mixed powder of graphite particles coated with nickel and halogenide is incorporated into a melt of a hypereutectic Al-Si (silicon) alloy melt and swirls are formed in the melt by an agitator to disperse the graphite particles uniformly into the melt and a method in which metal-coated graphite particles suspended in a carrier gas are blown into a melt of an aluminum alloy, as shown in Japanese patent publication Ser. No. 45-13224.

These methods, however, involve problems or defects described below. In each of these methods, it is an indispensable requirement that the surfaces of graphite particles to be dispersed should be metal-coated.

A metal coating may be formed on the surfaces of graphite particles by chemical plating or the like. However, the process includes complicated steps, problems are included in sewage treatment equipments and the like and therefore, the costs of products are disadvantageously increased.

Furthermore, since the surfaces of metal-coated graphite particles are in the oxidized state, even if they are thrown and dispersed into a melt, they are likely to rise to the surface of the melt because of a poor wettability with the melt and it is impossible to disperse the graphite particles uniformly into the melt. It is proposed that the wettability may be improved by treating the graphite particles in an atmosphere of hydrogen.

In this case, however, many blowholes are formed by discharge of hydrogen from the interior of the graphite particles and practically valuable products cannot be obtained.

It is necessary to incorporate graphite in aluminum or its alloy in an amount of 4 to 30% by weight in order to attain a sufficient lubricating effect of the graphite under dry friction. The use of metal-coated graphite particles is not suitable for throwing and dispersing such a large amount of graphite particles into a melt in a short time at a high efficiency.

Further, when it is intended to throw and disperse a large amount of metal-coated graphite particles into the melt at a time, heat necessary for melting the metal is taken from the melt as the matrix, and the temperature of the matrix is rapidly lowered to reduce the fluidity of the melt, and the added metal-coated graphite particles are apt to float to the surface of the melt. The metal-coated graphite particles which are once floated to the surface of the melt are not dispersed into the melt again because of the surface oxidation. Accordingly, when it is intended to disperse a large quantity of graphite particles into the melt, it is necessary to throw and disperse the graphite particles stepwise in incremental amounts, and hence, a long time is required for dispersing the predetermined amount of graphite.

When a long time is thus required for effecting dispersion of the graphite particles thrown and dispersed into the melt, the granular initial state graphite begins to float to the surface of the melt and therefore, the utilization efficiency of the graphite greatly deteriorates.

In the method of using the mixed powder, a considerable time is required for mixing, and it is very difficult to select an appropriate particle size suitable for mixing graphite particles to be dispersed with the melt. In using a carrier gas, graphite particles that can be used are limited to very fine particles, and a long time is required for completion of dispersion of a predetermined amount of graphite particles.

Thus, it has been desired in the art to develop a process for preparing aluminum alloys containing graphite which can use graphite particles not coated with a metal.

An object of the invention is to provide a process for preparation of graphite-containing aluminum alloys which can throw and disperse graphite particles of 2–30% by weight into aluminum or aluminum alloy melts in a short time as well as with an appropriate utilization efficiency.

Another object of the invention is to provide a process for preparation of graphite-containing aluminum alloys using graphite particles not coated with a metal so that it will be possible to use raw graphite particles in order to reduce the production cost.

Another object of the invention is to provide a process for preparation of graphite-containing aluminum alloys in which a casting structure is made fine and the graphite particles are hardly caused to float to the surface of the melt. One feature of the invention is in a process for preparation of graphite-containing aluminum alloys which comprises the steps of incorporating, e.g. by throwing 1.5–20% by weight of at least one additive metal selected from the group consisting of titanium (Ti), chromium (Cr), zirconium (Zr), nickel (Ni), vanadium (V), cobalt (Co), manganese (Mn) and niobium (Nb) into an aluminum or aluminum alloy melt, after throwing of said metal, throwing and dispersing 2–30% by weight of graphite particles within the melt and after that, solidifying the aluminum or aluminum alloy melt containing the graphite particles.

Instead of the above additive metal as a graphite floating protecting agent, it is possible to almost prevent, i.e. to reduce, floating of the graphite particles by adding phosphorus (P) in an amount of 0.1~3% by weight.

Another feature of the invention is in the step of solidifying the melt under the pressure of 400–1000 kg/cm$^2$ to make the sintered structure very fine and to suppress floating of the graphite particles.

As stated, according to the invention it is possible to prepare an aluminum casting alloy in which the graphite particles are substantially uniformly dispersed in the entire structure of the cast ingot, the metallic coating on the surface of the graphite particles is eliminated and floating of the graphite particles is lowered. In addition, even if the resulting aluminum alloy containing the graphite particles is made molten again, the graphite particles are not caused to float to the surface of the melt.

The drawing is a single FIGURE showing the relationship between the dispersed amount of graphite particles and the particle sizes of graphite when additive metals were incorporated into an aluminum alloy melt by varying the amount of additive metals.

The best known embodiment of the invention will hereinafter be explained in detail.

It is preferred that an aluminum alloy in which graphite particles are thrown and dispersed contains at least one of tin (Sn), copper (Cu), lead (Pb) and silicon (Si). The reason for the use of such alloys is that it is expected that when graphite particles are dispersed into Al-Sn, Al-Cu, Al-Pb and Al-Si alloys, which have heretofore been widely used for bearings and the like, the utilization value of the alloys will be further enhanced.

Before the graphite particles are thrown into the aluminum or aluminum alloy melt, at least one element selected from the group consisting of Ti, Cr, Zr, V, Nb, Ni, Co, Mn and P is incorporated into the aluminum or aluminum alloy melt. These elements have been chosen based on experimental results.

In addition to these 9 elements, tests were conducted with another 11 elements, namely, barium (Ba), beryllium (Be), cerium (Ce), iron (Fe), cesium (Cs), potassium (K), neptunium (Np), calcium (Ca), tungsten (W), hafnium (Hf) and antimony (Sb), but, it was found that the latter, i.e. the another 11 elements, have no effect to suppress the floating of graphite particles. The tested elements are commonly known as carbide-forming elements, and the first-mentioned nine elements alone were found to have an effect to suppress floating of the graphite particles. In case of these elements, when the textures of the resulting products were examined by an electron microscope at 1000 magnifications, no carbide layer was found in the interface between the graphite particles and the aluminum alloy.

As, pointed out hereinbefore, when graphite particles are incorporated in an amount of 2~30% by weight, the highest lubricating effect can be attained when the product is used under dry friction. It is difficult to attain a sufficient lubricating effect with the incorporation of less than 2% by weight of the graphite particles. While, when graphite particles are used in an amount larger than 30% by weight, the abrasion resistance is degraded and also the mechanical strength is lowered.

When graphite particles are incorporated in the range of 2~30% by weight, it is preferred that at least one of the elements of Ti, Cr, Zr, Ni, V, Co, Mn or Nb is previously incorporated into the melt in a range of 1.5~20% by weight. If such elements are incorporated in a total amount larger than 20% by weight, though the effect of preventing floating of graphite can be attained, there is a fear that unexpected defects will probably be caused if the resulting cast alloy as used as a bearing or piston.

Thus, it is not recommended to incorporate the total amount of such elements in the range of more than 20% by weight.

Instead of these elements, 0.1~3% by weight of P can be incorporated into the melt to attain a similar effect.

In a case that the graphite is incorporated in an amount of 20~30% by weight, the resultant aluminum alloys containing the graphite are suitable as metallic members to be used under low load and high speed.

In a case that the graphite is incorporated in an amount of 15~20% by weight, the resultant aluminum alloys are suitable as metallic members to be used under high load and low speed.

In a case that the graphite is incorporated in an amount of 2~15% by weight, especially 3~5% by weight, the resultant aluminum alloys are suitable as metallic members to be used under frictional conditions involving oil lubrication, because the graphite containing portions are effective in providing an oil reservoir.

It is most preferred that the temperature of the melt into which the graphite particles are thrown is in the range of from a temperature higher by 50° C. than the liquidus to about 900° C. When the temperature is not held above a level higher by 50° C. than the liquidus, the fluidity of the melt is degraded and defects such as blowholes are apt to be formed.

It is not preferred that the temperature of the melt be higher than 900° C., because the graphite particles are apt to float. It is possible to use part natural graphite particles or part synthetic graphite particles. The liquidus is at about 570° C. with an Al-Si alloy containing 12% by weight of Si, at about 700° C. with an Al-Si alloy containing 20% by weight of Si, at about 640° C. with an Al-Sn alloy containing 10% by weight of Sn and at about 650° C. with an Al-Cu alloy containing 4% by weight of Cu. It is recommended to add Cu, Mg, Ni, Zn, Mn or Pb, and the like alloying elements in small amounts to those two element-matrix systems to strengthen the matrix. The temperature of the liquidus changes with the amount of elements added to suppress floating of the graphite particles and in a case that graphite particles are suitably added to suppress floating thereof, the temperature only changes in the range of ±200° C.

The melt just before incorporating the graphite particles is kept stationary or is agitated. When the melt is kept stationary, the melt should be agitated after incorporating the graphite particles. In any event, once the graphite particles are incorporated, the graphite particles are suspended into swirls of the melt generated by agitation, whereby dispersion of the graphite particles is facilitated.

This operation is very important, and if this operation is not conducted, a cast ingot in which graphite particles are uniformly dispersed cannot be obtained. When the agitation of the melt is completed and the melt becomes stationary, it is solidified under pressure. This solidification under pressure results in a rapid solidification of the melt. The heat transfer between the melt and casting mold is enhanced by pressurization, the solidification or the melt is expedited and a fine cast structure is obtained.

In addition, the defects in the ingot also disappear. A pressure in the range of 400~1000 kg/cm$^2$ is preferred for effecting the pressure-solidification. When lower than 400 kg/cm$^2$, gas cannot be sufficiently taken out. When higher than 1000 kg/cm$^2$, such a high pressure is required that the pressure-applying device becomes too large and the cost of this equipment increases.

Also, it is possible to cast an ingot in which the graphite is uniformly dispersed by varying the form of metallic mold used for the casting, for instance by making the metallic mold diameter long and narrow, and by employing a water-cooling system.

In the aluminum alloy containing graphite, the graphite generally acts as a solid lubricant and greatly contributes to the improvement of the abrasion resistance. This effect is influenced by the size of the graphite particles used.

When the size of graphite particles is too small, cohesion takes place in graphite particles under friction and the graphite adheres to the frictional surface of a contacting member. This phenomenon is often observed when the particle size of the graphite is in the range of 20~50 μm. If the size is made smaller than these values, the graphite adhering to the contact is expelled from the friction system.

In view of the foregoing, it is preferred that graphite particles having an average particle diameter of 50 μm be used. The degree of the dispersion of the graphite particles is influenced by the agitating speed of the melt. On example is shown as follows: an aluminum alloy containing 12% Si and 3% of Cr by weight was made molten and held at a temperature of 700° C. in a graphite melting pot of an inner diameter 90 mm. In the agitation of a melt by a use of blades at varied speeds, natural graphite powder of 60~80 mesh size was added to the melt in an amount of 9% by weight and the dispersing condition of the graphite particles was observed. At a speed of rotation less than 50 rpm, swirls were not generated in the melt which was only stirred, so that it took a long time until the graphite particles were dispersed into the melt. In addition, a little part of the graphite particles did not disperse into the melt in spite of a long period of agitation, due to stains on the surface layers.

At an agitation rate greater than 500 rpm, it was observed that many disordered swirls were generated and the graphite particles incorporated floated to the surface of the melt. In the range of 50~500 rpm, normal swirls were generated and the graphite particles dispersed into the melt.

Some embodiments of the invention will be explained and contrasted with a number of comparative examples.

EMBODIMENT 1

In a graphite crucible having an inner diameter of 90 mm, 700 g of an Al-Si alloy containing 20% by weight of Si was made molten and the melt was held at a temperature of 650° C. A vane-shaped member was inserted into the crucible and the Al-Si alloy melt was rotated and agitated at 100 rpm by this member to form swirls in the melt.

Then, pulverized natural graphite having a size of 177~250 μm (80~60 mesh) was added to the melt in an amount of 9% by weight. One of Ti, Cr, Zr, V, Ni, Co, Mn and Nb was incorporated into the melt, and the amount of such additive element incorporated was changed to determine the amount of the additive element necessary to disperse the graphite particles in amounts up to 30% by weight without causing floating of the graphite particles. Measured results are shown in Table 1. It will be seen that if the melt contains one of these elements in an amount of 1~20% by weight, the graphite particles can be incorporated in the range of 2~30% by weight. In this process, solidification under pressure was carried out at 600 kg/cm$^2$.

An ingot incorporating graphite particles which contains an element effective to suppress floating of the graphite was made molten again, but the graphite particles did not float. There was not observed any difference by the dispersion of graphite particles on basis of the difference of the additive element.

COMPARATIVE EXAMPLE 1

In a graphite crucible having an inner diameter of 90 mm, 700 g of an Al-Si alloy containing 20% by weight of Si was made molten and the melt was held at a temperature of 850° C. A vane-shaped member was inserted into the crucible and the Al-Si alloy melt was rotated and agitated at 100 rpm by this member to form swirls in the melt. Then, pulverized natural graphite having a size of 177~250 μm (80~60 mesh) was added to the melt in an amount of 9% by weight and solidified under a pressure of 600 kg/cm$^2$. However, the graphite floated to the surface of the melt and did not disperse into the melt.

COMPARATIVE EXAMPLE 2

In a graphite crucible having an inner diameter of 90 mm, 700 g of an Al-Sn alloy containing 10% by weight of Sn was made molten and the melt was held at a temperature of 650° C. A vane-shaped member was inserted into the crucible and the Al-Sn alloy melt was rotated and agitated at 100 rpm by this member to form swirls in the melt. Then, pulverized natural graphite having a size of 177~250 μm (80~60 mesh) was added to the melt in 9% by weight and solidified under a pressure of 600 kg/cm$^2$. However, graphite particles floated to the surface of the melt and did not disperse into the melt.

COMPARATIVE EXAMPLE 3

Under the conditions identical to Comparative Example 1, an Al-Si alloy melt was made and the elements Ba, Be, Ce, Hf, Cs, Fe, K, Ca, Mg, Np and Sb were individually added to the melt. Then, the melt was rotated to make swirls therein. Under these conditions, pulverized natural graphite of 177~250 μm was added to the melt. However, the graphite particles floated to the surface of the melt and did not disperse into the melt.

TABLE 1

| | Amount of dispersed graphite particles (% by weight) | | | | | | | | | | | | | | |
|---|---|---|---|---|---|---|---|---|---|---|---|---|---|---|---|
| | Amount (wt/o) | | | | | | | | | | | | | | |
| Elements | 1 | 2 | 3 | 4 | 5 | 6 | 7 | 8 | 9 | 10 | 12 | 14 | 16 | 18 | 20 |
| Ti | 3 | 6 | 8 | 11 | 14 | 17 | 20 | 24 | 28 | 30 | 32 | — | — | — | — |
| Cr | 3 | 6 | 8 | 11 | 14 | 17 | 19 | 23 | 27 | 29 | 31 | — | — | — | — |
| Zr | 3 | 7 | 8 | 12 | 14 | 17 | 21 | 23 | 27 | 29 | 31 | — | — | — | — |
| V | 3 | 6 | 8 | 11 | 14 | 17 | 20 | 24 | 28 | 30 | 32 | — | — | — | — |
| Ni | 2 | 3 | 5 | 7 | 9 | 10 | 12 | 13 | 15 | 16 | 18 | 21 | 25 | 27 | 30 |
| Mn | 2 | 3 | 5 | 6 | 8 | 10 | 11 | 13 | 14 | 16 | 17 | 20 | 24 | 27 | 30 |

TABLE 1-continued

| | Amount of dispersed graphite particles (% by weight) | | | | | | | | | | | | | | |
|---|---|---|---|---|---|---|---|---|---|---|---|---|---|---|---|
| | Amount (wt/o) | | | | | | | | | | | | | | |
| Elements | 1 | 2 | 3 | 4 | 5 | 6 | 7 | 8 | 9 | 10 | 12 | 14 | 16 | 18 | 20 |
| Co | 3 | 6 | 8 | 12 | 14 | 17 | 20 | 24 | 28 | 30 | 32 | — | — | — | — |
| Nb | 2 | 3 | 5 | 7 | 9 | 12 | 16 | 18 | 21 | 25 | — | — | — | — | — |
| P | 6 | 16 | 30 | — | — | — | — | — | — | — | — | — | — | — | — |

EMBODIMENT 2

In a graphite crucible having an inner diameter of 90 mm, 700 g of pure aluminum was made molten and the resulting melt was held at a temperature of 710° C. A vane-shaped member was inserted into melt held in the crucible and the aluminum melt was rotated and agitated at 100 rpm by this member to form swirls in the melt. Then, pulverized natural graphite having a size of 177~250 μm (80~60 mesh) was added to the melt in an amount of 9% by weight. However, the graphite particles floated to the surface of the melt and did not disperse into the melt. In contrast, in a case where an Al-Ti alloy melt containing 5% by weight of Ti was held at a temperature of 1100° C. and under the above-mentioned agitation conditions, the graphite particles were added in the same amount, the graphite particles dispersed into the melt and did not float to the surface of the melt.

The aluminum melt containing the graphite was solidified under a pressure of 600 kg/cm$^2$ and an aluminum alloy containing the graphite was produced.

EMBODIMENT 3

In a graphite crucible having an inner diameter of 90 mm, an Al-Cu-Zr alloy containing 50% by weight of Cu and 3% by weight of Zr was made molten and the resulting melt was held at a temperature of 750° C. A vane-shaped member was inserted into the crucible and the Al-Cu-Zr alloy was rotated and agitated at 100 rpm by this member to form swirls in the melt. Then, pulverized natural graphite having a size of 150~105 μm (100~150 mesh), 177~150 μm (80~100 mesh), 250~177 μm (60~80 mesh), 500~250 μm (32~60 mesh), 710~500 μm (24~32 mesh) or more than 710 μm (+24 mesh) was added to the melt in an amount of 2% by weight at one time until floating of graphite particles took place, to determine the relation between the amount of the graphite dispersed and the particle size of the graphite. The pressure-solidification was carried out at a pressure of 600 kg/cm$^2$. Through similar methods under the change of Zr the relation between the amount of dispersed graphite and the particle size was determined. The results were shown in the single FIGURE of the accompanying drawing. In the FIGURE the region of I is a graphite floating region and the region of II is a graphite dispersing region. According to the FIGURE, it will be seen that the amount of dispersed graphite changes with the amount of additive element added and the graphite is likely to float to the surface of the melt in accordance with the particle size of graphite.

EMBODIMENT 4

In a graphite crucible having an inner diameter of 90 mm, an Al-Si alloy containing 12% by weight of Si was made molten and P (phosphorus) in amounts of 0.1, 0.5, 1.0, 2.0, 3.0 and 4.0% by weight was added to the melt respectively by a phosphorizer method. Then, the melts were held at a temperature of 700° C. A vane-shaped member was inserted into the crucible and the Al-Si-P alloy melt was rotated and agitated at 150 rpm by this member to form swirls in the melt.

Graphite particles having a size of 177 m~250 μm (80~60 mesh) was added to the melt at a rate of 2% by weight to determine the limit of the amount of dispersed graphite particles with regard to every melt. Through a similar procedure with an Al-Si alloy containing 20% by weight of Si, an Al-Sn alloy containing 5% by weight of Sn and an Al-Cu alloy containing 4% by weight of Cu, the limit of the amount dispersed graphite particles was determined. The results are shown in Table 2. According to the Table, it will be seen that the limited amount of dispersed graphite particles is influenced by the amount P (phosphorus), but not by the matrix. In addition, when it is needed to incorporate graphite particles in an amount more than 30% by weight, phosphorus can be added in the range of 3.0~4.0% by weight.

TABLE 2

Relation between the amount of added P and the amount of dispersed graphite particles

| | Amount of P (wt/o) | | | | | |
|---|---|---|---|---|---|---|
| Matrix | 0.1 | 0.5 | 1.0 | 2.0 | 3.0 | 4.0 |
| Al—12Si | 3.0 | 5.0 | 10.0 | 20.0 | 30.0 | 35.0 |
| Al—20Si | 3.0 | 5.0 | 10.0 | 20.0 | 30.0 | 35.0 |
| Al—5Sn | 3.0 | 5.0 | 10.0 | 20.0 | 30.0 | 35.0 |
| Al—4Cu | 3.0 | 5.0 | 10.0 | 20.0 | 30.0 | 35.0 |

*size of graphite 177~250 μm

We claim:

1. A process for preparation of graphitecontaining aluminum alloys by incorporating graphite into an aluminum or aluminum alloy melt, comprising the steps of incorporating at least one additive element selected from the group consisting of titanium, chromium, zirconium, nickel, vanadium, cobalt, mananese, and niobium in the range of 1.5~20% by weight into aluminum or an aluminum alloy melt; then, incorporating graphite particles, without a metal coating, into the melt in an amount of 2~30% by weight and dispersing the graphite particles into the melt; and thereafter, solidifying the aluminum or aluminum alloy melt containing the graphite particles; said graphite particles being dispersed within the solidified melt.

2. A process according to claim 1, wherein the graphite particles are incorporated in an amount of 20~30% by weight and the additive element is incorporated in the melt to suppress floating of the graphite particles to the surface of the melt.

3. A process according to claim 1, wherein the graphite particles are incorporated in an amount of 15~20% by weight and the additive element is incorporated in the melt to suppress floating of the graphite particles to the surface of the melt.

4. A process according to claim 1, wherein the graphite particles are incorporated in an amount of 2~15% by weight and the additive element is incorporated in the melt to suppress floating of the graphite particles to the surface of the melt.

5. A process according to claim 4, wherein the graphite particles are incorporated in an amount of 3~5% by weight.

6. A process according to claim 1, 2, 3 or 4, wherein the average particle size of the graphite particles is larger than 50 μm in diameter.

7. A process according to claim 1, 2, 3, or 4, wherein the aluminum alloy is an Al-Sn alloy, an Al-Cu alloy, an Al-Pb alloy or an Al-Si alloy.

8. A process according to claim 1, 2, 3 or 4, wherein the temperature of the melt is held between a temperature 50° C. higher than the liquidus of the melt and 900° C.

9. A process according to claim 1, 2, 3 or 4, wherein the aluminum or aluminum alloy melt containing graphite particles is solidified under the pressure of 400~1000 kg/cm$^2$.

10. A process according to claim 1, wherein the aluminum or aluminum alloy melt containing the graphite particles is solidified by water cooling.

11. A process for producing an aluminum alloy containing graphite by incorporating graphite particles into an aluminum or aluminum alloy melt, comprising the steps of incorporating at least one additive element selected from the group consisting of titanium, chromium, zirconium, nickel, vanadium, cobalt, manganese, niobium and phosphorus into an aluminum or aluminum alloy melt; then, incorporating and dispersing graphite particles, without metalcoating, into the melt; and thereafter, solidifying the aluminum or aluminum alloy melt containing the graphite under pressure; said graphite particles being dispersed within the solidified melt.

12. A process for preparation of graphitecontaining aluminum alloys by incorporating graphite particles into an aluminum or aluminum alloy melt, comprising the steps of incorporating phosphorus into the aluminum or aluminum alloy melt in an amount of 0.1~4% by weight; then, incorporating and dispersing graphite particles, without a metal coating, in an amount of 4~30% by weight into the melt; and thereafter, solidifying the aluminum or aluminum alloy melt containing the graphite; said graphite particles being dispersed within the solidified melt.

13. A process according to claim 10 or 11, wherein the average size of graphite particles is larger than 50 μm.

14. A process according to claim 10 or 11, wherein the aluminum alloy is an Al-Sn alloy, an Al-Cu alloy, an Al-Pb alloy or an Al-Si alloy.

15. A process according to claim 10 or 11, wherein the temperature of the melt is held between a temperature 50° C. higher than the liquidus of the melt and 900° C.

16. A process according to claim 10 or 11, wherein the aluminum or aluminum alloy melt containing the graphite particles is solidified under the pressure of 400~1000 kg/cm$^2$.

17. A process according to claim 11, wherein the aluminum or aluminum alloy melt containing the graphite particles is solidified by water cooling.

18. A process for producing aluminum alloys having graphite particles dispersed therein, which comprises forming a melt of aluminum or an aluminum alloy; said melt containing 1 to 20% by weight of at least one additive element selected from the group consisting of titanium, chromium, zirconium, nickel, vanadium, cobalt, manganese and niobium or 0.1 to 4% by weight of phosphorus; dispersing 2 to 30% by weight of graphite particles, without a metal coating into said melt by throwing the graphite particles into the melt and by agitating the melt to form swirls therein; and thereafter solidifying the melt containing the graphite particles; said graphite particles being dispersed in the solidified melt.

19. A process according to claim 18, wherein said melt is formed by melting an admixture containing aluminum and said at least one additive element.

20. A process according to claim 18, wherein said aluminum alloy contains 1 to 20% by weight of said at least one additive element and a balance of aluminum.

21. A process according to claim 18, wherein the temperature of the melt into which the graphite particles are thrown is in a range of from a temperature higher by 50° C. than the liquidus of the melt to about 900° C.

22. A process according to claim 21, wherein the melt is agitated at an agitation rate in the range of 50~500 rpm.

* * * * *